US006750597B1

(12) United States Patent
Sakura

(10) Patent No.: US 6,750,597 B1
(45) Date of Patent: Jun. 15, 2004

(54) METHOD FOR MANUFACTURING SPARK PLUG AND SPARK PLUG

(75) Inventor: Akio Sakura, Aichi (JP)

(73) Assignee: NGK Spark Plug, Co., Ltd., Aichi (JP)

( * ) Notice: Subject to any disclaimer, the term of this patent is extended or adjusted under 35 U.S.C. 154(b) by 522 days.

(21) Appl. No.: 09/640,155

(22) Filed: Aug. 16, 2000

(30) Foreign Application Priority Data

Aug. 26, 1999 (JP) ..... 11-240206

(51) Int. Cl.[7] ..... H01T 13/20
(52) U.S. Cl. ..... 313/141; 313/142
(58) Field of Search ..... 313/141, 142, 313/118

(56) References Cited

U.S. PATENT DOCUMENTS 4,581,558 A * 4/1986 Takamura et al. ..... 313/141
4,967,116 A * 10/1990 Oshima ..... 313/141

FOREIGN PATENT DOCUMENTS

DE 19638176 Abstract 4/1998 ..... C23C/22/48
JP 08236263 Abstract 9/1996 ..... H01T/13/20
JP 2001068250 * 3/2001 ..... H01T/13/20
JP 2001110545 * 4/2001 ..... H01T/13/20
JP 2001316846 * 11/2001 ..... H01T/13/02

* cited by examiner

*Primary Examiner*—Nimeshkumar D. Patel
*Assistant Examiner*—Karabi Guharay
(74) *Attorney, Agent, or Firm*—Brinks Hofer Gilson & Lione

(57) ABSTRACT

A method for manufacturing a spark plug having a center electrode, an insulator disposed around the center electrode, a metallic shell disposed around the insulator, a ground electrode disposed in opposition to the center electrode so as to form a spark discharge gap therebetween, and a chip of a high melting point metal welded to at least the ground electrode. A zinc-based plating layer is formed on the surface of a metallic shell assembly composed of the metallic shell and the ground electrode, a root-end of which is welded to the metallic shell. Subsequently, the zinc-based plating layer is removed from a free-end portion of the ground electrode. The chip of a high melting point metal is welded to the free-end portion of the ground electrode from which the zinc-based plating layer has been removed.

15 Claims, 8 Drawing Sheets

METHOD FOR MANUFACTURING SPARK PLUG AND SPARK PLUG

BACKGROUND OF THE INVENTION

1. Field of the Invention

The present invention relates to a spark plug for use in an internal combustion engine and to a method for manufacturing the same.

2. Description of the Related Art

A typical spark plug used for ignition in a gasoline internal combustion engine for automobile use, includes a center electrode, an insulator disposed around the center electrode, a metallic shell disposed around the insulator, and a ground electrode joined to the metallic shell so as to form a spark discharge gap in cooperation with the center electrode. The spark plug is mounted on the cylinder head of the engine by means of threads formed on the outer circumferential surface of the metallic shell. Generally, the metallic shell is made of an iron-based material, such as carbon steel, and in many cases is plated with zinc for corrosion protection. Further, in order to improve anticorrosive performance, the surface of the zinc plating layer is subjected to chromate treatment.

For plating the metallic shell with zinc, so-called barrel plating is effective in terms of productivity. However, if the ground electrode is joined to the metallic shell through, for example, resistance welding after the barrel plating process is performed, a poor weld is likely to result, due to the presence of the zinc plating layer (or chromate layer). Also, since the zinc plating layer is destroyed at the weld zone, corrosion resistance is impaired. Generally, therefore, the ground electrode is joined to the metallic shell, and subsequently the resultant metallic shell assembly is plated with zinc through barrel plating and, as needed, subjected to subsequent chromate treatment.

Manufactured in accordance with the above-mentioned method, the surface of the ground electrode welded to the metallic shell is also covered with the zinc plating layer and in some cases with an additional chromate layer. If the insulating chromate layer covers a portion of the ground electrode which is to define a spark gap, discharge performance will be adversely effected. In order to improve resistance to spark-induced consumption, it has been determined that a chip containing a predominant amount of a high melting point metal, such as Pt or Ir, is welded to both the ground electrode and the center electrode at respective positions corresponding to the spark gap so as to form spark portions. However, when the chip of a high melting point metal is welded to the ground electrode, the existing zinc plating layer, and in some cases additional chromate layer, may cause a poor weld, potentially causing separation of the chip from the ground electrode.

In order to avoid the above-mentioned problem, a base metal of a free-end portion of the ground electrode is exposed without being covered with the zinc plating layer, so as to weld the chip of a high melting point metal to the exposed base metal. Conventionally, in order to maintain a free-end portion of the ground electrode in a bare state, a rubber tube, for example, is fitted to the free-end portion so as to prevent contact with a plating solution, thereby preventing formation of the zinc plating layer thereon. Because of difficulty in fitting the rubber tube to the free-end portion and difficulty in automating the fitting process, this method is of very poor efficiency. Also, when the metallic shell assembly is handled for fitting the rubber tube to a free-end portion of the ground electrode, oil and dirt are likely to adhere to the free-end portion. Such adhering oil and dirt impair welding of the chip, potentially causing separation of the chip from the ground electrode.

SUMMARY OF THE INVENTION

The present invention provides a method for manufacturing a spark plug including a center electrode; an insulator disposed around the center electrode; a cylindrical metallic shell disposed around the insulator; a ground electrode disposed in opposition to the center electrode so as to form a spark discharge gap therebetween; and a chip of a high melting point metal welded to at least the ground electrode at a position corresponding to the spark discharge gap so as to form a noble metal spark portion having a discharge face. The method comprises the steps of preparing a metallic shell assembly through joining of a root-end portion of the ground electrode to an open end portion of the metallic shell; forming a zinc-based plating layer containing a predominant amount of zinc on a surface of the metallic shell assembly; removing the zinc-based plating layer from a free-end portion of the ground electrode of the metallic shell assembly covered with the zinc-based plating layer; and welding the chip of a high melting point metal to the free-end portion of the ground electrode from which the zinc-based plating layer has been removed.

As described above, the method of the present invention does not involve a conventional masking process; i.e., a step of masking the free-end portion of the ground electrode with a rubber tube in order to prevent formation of a plating layer thereon. Thus, the invented method can manufacture at high efficiency a spark plug having a chip of a high melting point metal, serving as a spark portion, welded to the ground electrode. Also, the invented method avoids adhesion of dirt and oil which would otherwise result from employment of the masking process. Through execution of the step of removing the zinc-based plating layer, the surface of the base metal of the ground electrode is appropriately eroded to thereby be cleaned. As a result, weld strength of the chip is enhanced, thereby avoiding separation of the chip from the ground electrode.

A physical process, such as ion etching or shotblasting, may be employed in the step of removing the zinc-based plating layer. However, preferably, the ground electrode covered with the zinc-based plating layer is immersed in a remover so as to chemically remove the zinc-based plating layer therefrom. This chemical process enhances the efficiency of the removal. Also, the etching effect of the remover brings about cleaning of the surface of the base metal of the ground electrode.

Preferably, in order to chemically remove the zinc-based plating layer from the ground electrode covered with the zinc-based plating layer, the covered ground electrode is immersed in an acid remover so as to electrolessly remove the zinc-based plating layer therefrom. Preferably, the acid remover contains at least any one of nitric acid, hydrochloric acid, sulfuric acid, and an organic acid. This acid remover exhibits excellent performance in removing the zinc-based plating layer and thus can be used effectively in the present invention. Particularly, a mixture of nitric acid and hydrochloric acid is preferred as the acid remover. This mixture not only exhibits excellent performance in removing the zinc-based plating layer, but also is less likely to impair or discolor the surface of the base metal of the ground electrode, when the base material is an Ni-based metal (for example, an Ni-based heat resistant alloy) or an Fe-based heat resistant alloy. The base metal exposed through removal of the zinc-based plating layer exhibits good weldability to the chip of a high melting point metal. Preferably, in order to remove the zinc-based plating layer from a free-end portion of the ground electrode, the ground electrode is immersed in the remover such that a predetermined length of the root-end portion is exposed above the surface of the remover while the remaining free-end portion is submerged in the remover, thereby removing the zinc-based plating layer from the submerged free-end portion. Through mere adjustment of the depth of immersion of the ground electrode in the remover, the zinc-based plating layer can be removed from a predetermined length of the free-end portion.

Preferably, when the spark plug is configured such that a free-end portion of the ground electrode is bent so as to form the spark discharge gap in cooperation with an end portion of the center electrode, the zinc-based plating layer is removed from the free-end portion of the ground electrode in the following manner. The metallic shell assembly subjected to the process for removing the zinc-based plating layer is configured such that the ground electrode before being bent is joined to the metallic shell in such a manner as to extend linearly in the axial direction of the metallic shell assembly. The metallic shell assembly is held such that the ground electrode extends downward so as to immerse the free-end portion of the ground electrode in the remover. This method enables simple removal of the zinc-based plating layer from the free-end portion over a constant length, through a simple operation of holding the metallic shell assembly at a predetermined height by use of a jig or the like, while maintaining the level of the remover constant.

Preferably, the chip of a high melting point metal contains a predominant amount of Pt so as to facilitate resistance welding thereof. The surface of the base metal—which has been exposed through removal of the zinc-based plating layer and to which the chip is welded—is activated through use of the acid remover, thereby promoting mutual diffusion between the chip material and the ground electrode material in the course of resistance welding. Therefore, the resultant spark portion of the ground electrode assumes high weld strength. This effect becomes remarkable when the ground electrode is formed of an Ni-based metal (for example, an Ni-based heat resistant alloy) or an Fe-based heat resistant alloy.

When the ground electrode is formed of an Ni-based metal containing a predominant amount of Ni or an Fe-based metal containing a predominant amount of Fe, the above-described method realizes the following spark plug according to the present invention. That is, there can be provided a spark plug which comprises a center electrode; an insulator disposed around the center electrode; a metallic shell disposed around the insulator; a ground electrode disposed in opposition to the center electrode so as to form a spark discharge gap therebetween, the ground electrode being formed of an Ni-based metal containing a predominant amount of Ni or an Fe-based metal containing a predominant amount of Fe; and a Pt-based metal chip containing a predominant amount of Pt and welded to the ground electrode, wherein a surface of said metallic shell and a surface of a root-end portion of said ground electrode are covered with a zinc-chromate layer including a zinc-based plating layer containing a predominant amount of zinc and a chromate layer covering the zinc-based plating layer, such that a free-end portion of the ground electrode is exposed; the Pt-based metal chip is welded to the exposed free-end portion of the ground electrode at a position corresponding to the spark discharge gap so as to form a noble metal spark portion; and a diffusion layer, formed at an interface where the noble metal spark portion and the ground electrode are joined, has a thickness of not less than 10 $\mu$m.

Since mutual diffusion between the chip material and the ground electrode material is promoted in the course of resistance welding, the diffusion layer formed at the interface where the noble metal spark portion and the ground electrode are joined reliably attains an average thickness of not less than 10 $\mu$m, thereby enhancing weld strength of the spark portion. As a result, separation of the chip is less likely to occur, even during high load operation.

Preferably, in order to enhance corrosion resistance of the metallic shell, a chromate layer is formed on the zinc-based plating layer through chromate treatment. This chromate treatment can be performed irrespective of whether or not the spark portion made of a high melting point metal is formed on the ground electrode. The present invention provides a method for manufacturing a spark plug which involves this chromate treatment. Specifically, the present invention provides a method for manufacturing a spark plug comprising a center electrode, an insulator disposed around the center electrode, a metallic shell disposed around the insulator, and a ground electrode disposed in opposition to the center electrode so as to form a spark discharge gap therebetween. The method comprises the steps of: preparing a metallic shell assembly through joining of a root-end portion of the ground electrode to an open end portion of the metallic shell assuming the form of a cylinder; forming a zinc-based plating layer containing a predominant amount of zinc on the surface of the metallic shell assembly excluding a free-end portion of the ground electrode, such that the free-end portion of the ground electrode is exposed without being covered with the zinc-based plating layer; and immersing in a chromate treatment liquid the entire metallic shell assembly which has undergone the step of forming the zinc-based plating layer, thereby subjecting the zinc-based plating layer to chromate treatment.

A spark plug according to the present invention is manufactured by the above-described method. The spark plug comprises a center electrode; an insulator disposed around the center electrode; a metallic shell disposed around the insulator; and a ground electrode disposed in opposition to the center electrode so as to form a spark discharge gap therebetween. The surface of the metallic shell and the surface of a root-end portion of the ground electrode are covered with a zinc-chromate layer including a zinc-based plating layer containing a predominant amount of zinc and a chromate layer covering the zinc-based plating layer, such that a free-end portion of the ground electrode is exposed without being covered with the zinc-based plating layer. In the zinc-chromate layer, the chromate layer is formed in such a manner as to cover an axial end face of the zinc-based plating layer with respect to the axial direction of the ground electrode.

Preferably, the chromate treatment is performed after completion of the step of removing the zinc-based plating layer from the free-end portion of the ground electrode. If, after chromate treatment is completed, chemical removal of the zinc-based plating layer through immersion of the ground electrode in a remover is performed, the formed chromate layer serves as a protection film, causing difficulty in removing the zinc-based plating layer. Also, at a position where the zinc-based plating layer and the chromate layer terminate to thereby cause exposure of the surface of a base metal, an end face of the zinc-based plating layer is exposed without being covered with the chromate layer. As a result, the zinc-based plating layer is likely to be corroded from the end face thereof. However, if the chromate treatment is performed after the zinc-based plating layer is removed from the free-end portion of the ground electrode, the chromate layer covers the remaining zinc-based plating layer including the end face thereof, thereby further enhancing corrosion resistance.

Thus it is an object of the present invention is to provide a method for manufacturing a spark plug capable of efficiently forming a zinc plating layer on an integrated assembly of a metallic shell and a ground electrode excluding a free-end portion of the ground electrode.

It is a further object of the present invention is to provide a spark plug manufactured by the method, particularly a spark plug which is less likely to involve poor welding of a chip of a high melting point metal to the free-end portion to thereby avoid the potentiality of separation of the chip from the ground electrode.

DESCRIPTION OF THE PREFERRED EMBODIMENT

An embodiment of the present invention will next be described in detail with reference to the drawings.

Figure 1:
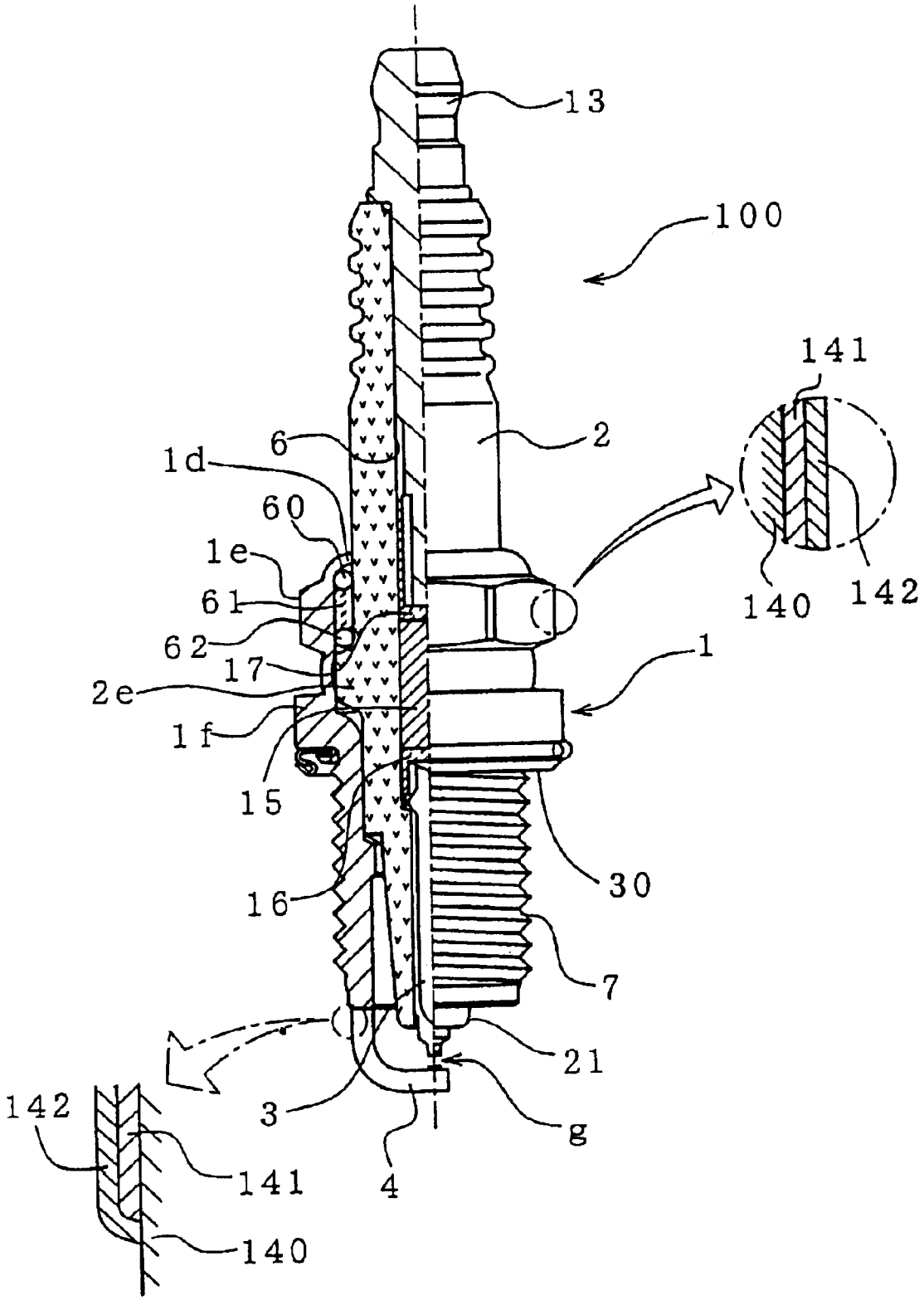
FIG. 1 is a longitudinal, half-sectional view showing a spark plug according to an embodiment of the present invention.
Figure 2:
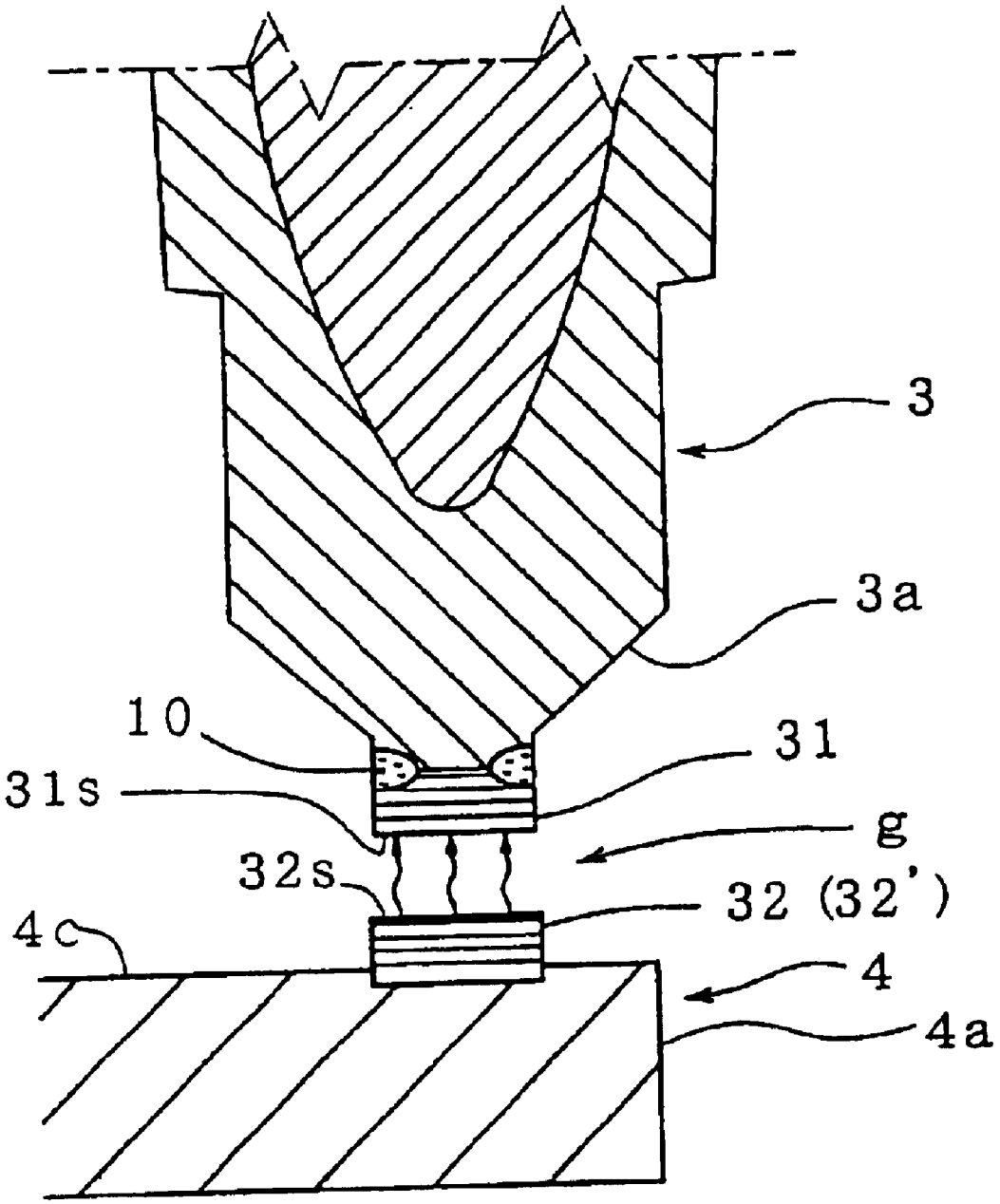
FIG. 2 is a longitudinal fragmentary view in full section showing essential portions of the spark plug of FIG. 1.

FIGS. 1 and 2 shown an embodiment of a spark plug 100 according to the present invention. The spark plug 100 includes a cylindrical metallic shell 1; an insulator 2 which is fitted into the metallic shell 1 such that an end portion projects from the metallic shell 1; a center electrode 3 which is disposed within the insulator 2 such that a spark portion 31 of a high melting point metal formed at an end thereof projects from the insulator 2; and a ground electrode 4, one end of which is joined to the metallic shell 1 through, for example, welding, and the other end portion of which is bent such that a side surface thereof faces an end portion of the center electrode 3. A spark portion 32 of a Pt-based metal (a kind of a spark portion of a high melting point metal) is formed on the ground electrode 4 in such a manner as to face the spark portion 31 of a high melting point metal, thereby defining a spark discharge gap g therebetween.

Herein, the expression "spark portion" refers to a portion of a member welded to the ground or center electrode which is free from alteration in composition caused by welding (a portion of the member which is not alloyed with the material of the ground or center electrode in the course of welding).

The insulator 2 is formed from sintered ceramic, such as alumina or aluminum nitride and has a through hole 6 formed therein in the axial direction thereof in order to receive the center electrode 3. A metallic terminal 13 is fixedly inserted into one end portion of the through hole 6, while the center electrode 3 is fixedly inserted into the other end portion of the through hole 6. A resistor 15 is disposed between the metallic terminal 13 and the center electrode 3 within the through hole 6. Opposite end portions of the resistor 15 are electrically connected to the center electrode 3 and the metallic terminal 13 by means of conductive glass seal layers 16 and 17, respectively.

The metallic shell 1 is made of metal, such as carbon steel, and formed into a cylindrical shape. The metallic shell 1 serves as a housing of the spark plug 100. A male threaded portion 7 is formed on the outer circumferential surface of the metallic shell 1 and adapted to mount the spark plug 100 to an engine block (not illustrated). Reference numeral 1*e* denotes a tool engagement portion, with which a tool, such as spanner or wrench, is engaged and which assumes a hexagonal cross section. A ring-shaped wire packing 62 is disposed around the insulator 2 adjacent the rear circumferential edge of a flange-like portion 2*e* while being interposed between the inner surface of a rear open end portion of the metallic shell 1 and the outer surface of the insulator 2 (the term "rear" refers to an upward direction in FIG. 1). A ring packing 60 is disposed around the insulator 2 and in the rear of the ring packing 62 while a filler layer 61, such as talc, is interposed therebetween. While the insulator 2 is pressed forward into the metallic shell 1 (the term "frontward" refers to a downward direction in FIG. 1), the rear open end portion of the metallic shell 1 is caulked toward the packing 60 to thereby form a caulked portion 1*d*. Thus, the metallic shell 1 and the insulator 2 are fixedly united.

A gasket 30 is fitted to a root-end portion of the screw portion 7 of the metallic shell 1. This gasket 30 is formed from a metal plate, such as a carbon steel plate, through bending and assumes the form of a ring. When the male threaded portion 7 is screwed into a tapped hole formed in a cylinder head, the gasket 30 is compressed axially between a flange-like gas seal portion 1*f* of the metallic shell 1 and a peripheral portion of the tapped hole and crushed to deformation, thereby sealing the tapped hole and the male threaded portion 7 against each other.

A zinc plating layer (zinc-based plating layer) 141 is formed for corrosion prevention on the entire surface of a base metal (for example, carbon steel) 140 of the metallic shell 1. The zinc plating layer 141 is covered with a chromate layer 142, thereby forming a zinc-chromate layer. The zinc-chromate layer composed of a zinc plating layer and a chromate layer is also formed on the surface of the gasket 30. As shown in FIG. 1, the zinc plating layer 141 and the chromate layer 142 formed on the metallic shell 1 extend toward the ground electrode 4 to thereby cover a root-end portion of the ground electrode 4. The surface of the base metal 140 is exposed at the residual free-end portion of the ground electrode 4. The chromate layer 142 is formed so as to cover the axial end face of the zinc plating layer 141 with respect to the axial direction of the ground electrode.

A zinc plating layer and a chromate layer are formed on the metallic shell 1 and the gasket 30 by the same process. Thus, only the process for forming the zinc plating layer 141 and the chromate layer 142 on the metallic shell 1 will be described. The zinc plating layer 141 is formed by a known galvanization process and assumes a thickness of about 3 $\mu$m to 10 $\mu$m. When the thickness is less than 3 $\mu$m, sufficient corrosion resistance may not be obtained. By contrast, a thickness in excess of 10 $\mu$m is unnecessarily thick in terms of corrosion resistance and lengthens the plating period of time, causing an impairment in the efficiency of manufacture with a resultant increase in cost of manufacture.

Conventionally used yellow chromate film may be employed as the chromate layer 142. Since the yellow chromate film contains a chromium component partially in the form of hexavalent chromium, and concern about environmental protection has been globally growing in recent years, use of the yellow chromate film has declined. Thus, the chromate layer 142 is preferably formed of a trivalent chromium-based chromate layer in which trivalent chromium accounts for 95% by weight or more.

When a conventional trivalent chromium-based chromate film, such as a glossy chromate film or a blue chromate film, is used as the chromate layer 142, it may fail to impart sufficient corrosion resistance and heat resistance to the metallic shell 1 in order to endure regular working conditions of a spark plug, since the thickness thereof is up to about 0.1 $\mu$m. Thus, by imparting a thickness of not less than 0.2 $\mu$m to the chromate layer 142, anticorrosive performance of a chromate film containing a predominant amount of trivalent chromium is greatly improved, thereby imparting sufficient corrosion resistance to the metallic shell 1. Even in the working environment peculiar to a spark plug, in which the temperature tends to increase and the spark plug is attacked by acid, the metallic shell 1 can exhibit sufficient corrosion resistance. When the thickness of the chromate layer 142 is less than 0.2 $\mu$m, anticorrosive performance and heat resistance become insufficient. When the thickness is in excess of 0.5 $\mu$m, the chromate layer 142 is likely to crack (for example, in the course of assembly) or exfoliate, resulting in impaired anticorrosive performance. Therefore, the thickness of the chromate layer 142 is preferably 0.3 $\mu$m to 0.5 $\mu$m. It is preferable that the chromate layer 142 contain substantially no hexavalent chromium.

A heat resistant alloy containing a predominant amount of Ni or Fe is used as a base metal of the center electrode 3 and the ground electrode 4 on which the above-mentioned zinc-chromate layer is formed. Examples of such a heat-resistant alloy include the following:

1 Ni-based heat resistant alloy: A generic term, herein, for heat resistant alloys which contain 40% by weight to 85% by weight Ni and at least one component selected from the group consisting of Cr, Co, Mo, W, Nb, Al, Ti, and Fe and accounting for a predominant portion of the balance. Specific examples include the following trade names (for compositions, refer to "Metal Data Book, Third Edition," Maruzen, p138):

ASTROLOY, CABOT 214, D-979, HASTELLOY C22, HASTELLOY C276, HASTELLOY G30, HASTELLOY S, HASTELLOY X, HAYNES 230, INCONEL 587, INCONEL 597, INCONEL 600, INCONEL 601, INCONEL 617, INCONEL 625, INCONEL 706, INCONEL 718, INCONEL X750, KSN, M-252, NIMONIC 75, NIMONIC 80A, NIMONIC 90, NIMONIC 105, NIMONIC 115, NIMONIC 263, NIMONIC 942, NIMONIC PE11, NIMONIC PE16, NIMONIC PK33, PYROMET 860, RENE 41, RENE 95, SSS 113MA, UDIMET 400, UDIMET 500, UDIMET 520, UDIMET 630, UDIMET 700, UDIMET 710, UDIMET 720, UNITEP AF2-1 DA6, WASPALOY.

2 Fe-based heat resistant alloy: A generic term, herein, for heat resistant alloys which contain 20% by weight to 60% by weight Fe and at least one component selected from the group consisting of Cr, Co, Mo, W, Nb, Al, Ti, and Ni and accounting for a predominant portion of the balance. Specific examples include the following trade names (for compositions, refer to "Metal Data Book, Third Edition," Maruzen, p138): A-286, ALLOY 901, DISCALOY, HAYNES 556, INCOLOY 800, INCOLOY 801, INCOLOY 802, INCOLOY 807, INCOLOY 825, INCOLOY 903, INCOLOY 907, INCOLOY 909, N-155, PYROMET CTX-1, PYROMET CTX-3, S-590, V-57, PYROMET CTX-1, 16-25-6, 17-14CuMo, 19-9DL, 20-Cb3.

In the present embodiment, the center core 3 and the ground electrode 4 use INCONEL 600 as a base metal (an internal Cu-based metal layer may be included for improvement of heat conduction). INCONEL 600 has the following composition: 76% by weight Ni, 15.5% by weight Cr, 8% by weight Fe.

The spark portion 31 (or a chip 31') of a high melting point metal of the center electrode 3 is made of a high melting point metal containing a predominant amount of a component selected from the group consisting of Ir, Rh, Pt, W, Re, and Ru; for example, a high melting point metal containing a predominant amount of Ir. Through use of such a high melting point metal, the spark portion 31 can exhibit good resistance to consumption even when used in an environment where the temperature of the center electrode 3 tends to increase. Also, such a high melting point metal exhibits good weldability to the above-mentioned heat resistant alloys. The spark portion 32 (or a chip 32') of a Pt-based metal of the ground electrode 4 is made of, for example, Pt, a Pt—Ni alloy (for example, a Pt—Ni alloy containing 1% by weight to 30% by weight Ni), a Pt—Ir alloy, or a Pt—Ir—Ni alloy. The spark portion 32 of a Pt-based metal is formed through resistance welding of the chip 32' of a Pt-based metal to the exposed base metal 140, which is not covered with the zinc-chromate layer.

Notably, the spark portion 31 made of Ir involves consumption induced by oxidation and volatilization rather than spark-induced consumption, since Ir is likely to oxidize and volatilize at high temperature. Thus, the spark portion 31 is made of an Ir alloy which contains a predominant amount of Ir and at least one additional component selected from the group consisting of Pt, Rh, Ru, Pd, and Re, thereby effectively suppressing oxidation and volatilization with resultant good resistance to consumption.

A method for manufacturing the above-described spark plug 100 will be described.

First, the zinc-chromate layer is formed on the metallic shell 1 in the following manner. A root-end portion of the ground electrode 4 is welded to an open end portion of the metallic shell 1 corresponding to the male threaded portion 7, thereby forming a metallic shell assembly W. At this stage, the ground electrode 4 is not bent, but extends linearly in the axial direction of the metallic shell 1. This metallic shell assembly W is galvanized by use of a barrel plating apparatus 199 shown in FIG. 3. A plurality of metallic shell assemblies W are placed in bulk in a container 202 of the barrel plating apparatus 199. The container 202 includes a mesh wall or a plate wall having a number of holes formed therein so that liquid can enter or leave the same. The container 202 loaded with the metallic shell assemblies W is immersed in a plating bath L1 contained in a plating tank 200. A counter electrode 203 is disposed in the plating bath L1, and an electricity supplying electrode 205 is disposed in the container 202. While the container 202 is rotated about a horizontal axis by means of a motor 201, electricity is supplied from a DC power supply 204 to the electricity supplying electrode 205 such that current flows between the metallic shell assemblies W and the counter electrode 203 via the electricity supplying electrode 205, thereby galvanizing the metallic shell assemblies W. In place of the above-described rotary-type barrel plating apparatus, a rocking-type barrel plating apparatus may be used.

Figure 5:
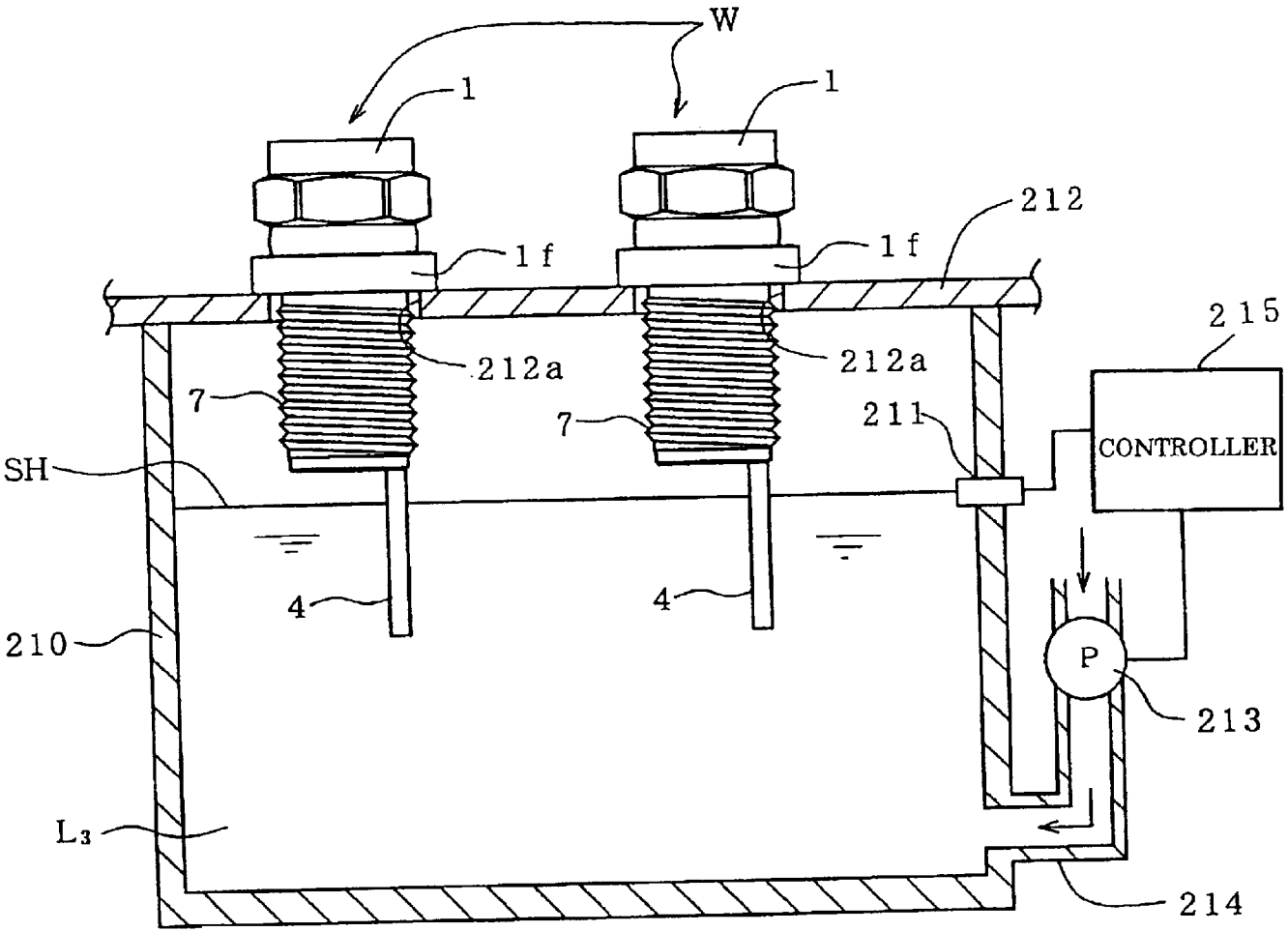
FIG. 5 is a schematic view showing an apparatus for removing a zinc plating layer.
Figure 6A:
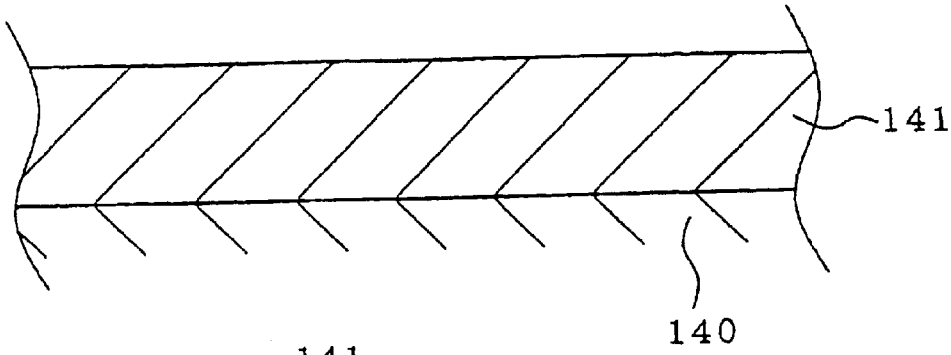
FIG. 6A is a schematic view showing a zinc layer on a base metal according to the process of the present invention.

As a result of the above-described galvanization, as shown in FIG. 6A, the zinc plating layer 141 covers the entire surface of the ground electrode 4; i.e., the entire surface of the base metal 140. As shown in FIG. 2, a noble metal chip; for example, the chip 32' of a Pt-based metal, is welded to a free-end portion of the ground electrode 4 to thereby form the spark portion 32. If the chip 32' is welded to the free-end portion covered with the zinc plating layer 141, zinc melts into the weld zone, causing a significant impairment in weld strength of the spark portion 32. Thus, the zinc plating layer 141 is removed from the free-end portion of the ground electrode 4 by a process illustrated in FIG. 5.

The apparatus of FIG. 5 includes a remover tank 210 which contains an acid remover L3. The acid remover L3 contains, for example, hydrochloric acid and nitric acid. A top opening portion of the remover tank 210 is covered with a holder plate 212 having metallic shell assembly reception holes 212*a* formed therein. The metallic shell assemblies W are inserted into the corresponding metallic shell assembly reception holes 212*a* such that the ground electrodes 4 face downward, while the gas seal portions If rest on the corresponding edge portions of the metallic shell assembly reception holes 212*a*. The remover L3 is supplied to the remover tank 210 through a remover inlet 214 from a remover storage tank (not illustrated) by use of a pump 213. A level sensor 211 disposed within the remover tank 210 detects the level of the remover L3. Upon reception of a signal from the level sensor 211 indicative of a drop in the level of the remover L3, a controller 215 causes the pump 213 to operate so as to maintain the surface SH of the remover L3 at a constant level.

Figure 6B:
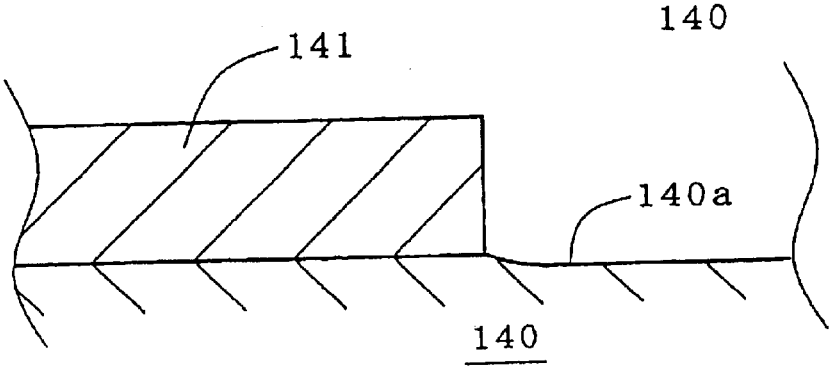
FIG. 6B is a schematic view showing a portion of the zinc layer removed from the base metal according to the process of the present invention.

Each of the metallic shell assemblies W is held at a constant height by means of the holder plate 212, while a free-end portion of the ground electrode 4 is immersed in the remover L3 such that a predetermined length of a root-end portion of the ground electrode 4 projects above the surface SH of the remover L3. As a result, as shown in FIG. 6B, the zinc plating layer 141 is removed from the immersed portion of the ground electrode 4 through dissolution. The thus-exposed surface 140*a* of the base metal 140 is etched by acid to thereby be activated.

When an aqueous solution of nitric acid and hydrochloric acid, for example, is used as the remover L3, preferably, nitric acid is contained in an amount of 10% by weight to 30% by weight, and hydrochloric acid is contained in an amount of 20% by weight to 30% by weight such that a removal effect of a proper degree is attained. The ratio of hydrochloric acid content WHCl (% by weight) to nitric acid content WHNO3 (% by weight), WHCl/WHNO3, is preferably about 0.5 to 4. This range of WHCl/WHNO3 brings a good state of finish of the base metal after the zinc plating layer 141 is removed.

Preferably, the height of the opening end face of the male-threaded portion 7 of the metallic shell 1 above the surface SH of the remover L3 is adjusted to, for example, 1 mm or more. When the height is less than 1 mm, the remover L3 comes into contact with the end face of the metallic shell 1 even when the surface SH of the remover L3 is slightly rippled, causing removal of the zinc plating layer 141 from an undesirable portion of the metallic shell 1. Even when the remover L3 does not come into contact with the metallic shell 1, an acid vapor has an adverse effect on the metallic shell 1, potentially causing a failure to impart sufficient corrosion resistance to the metallic shell 1.

Figure 3:
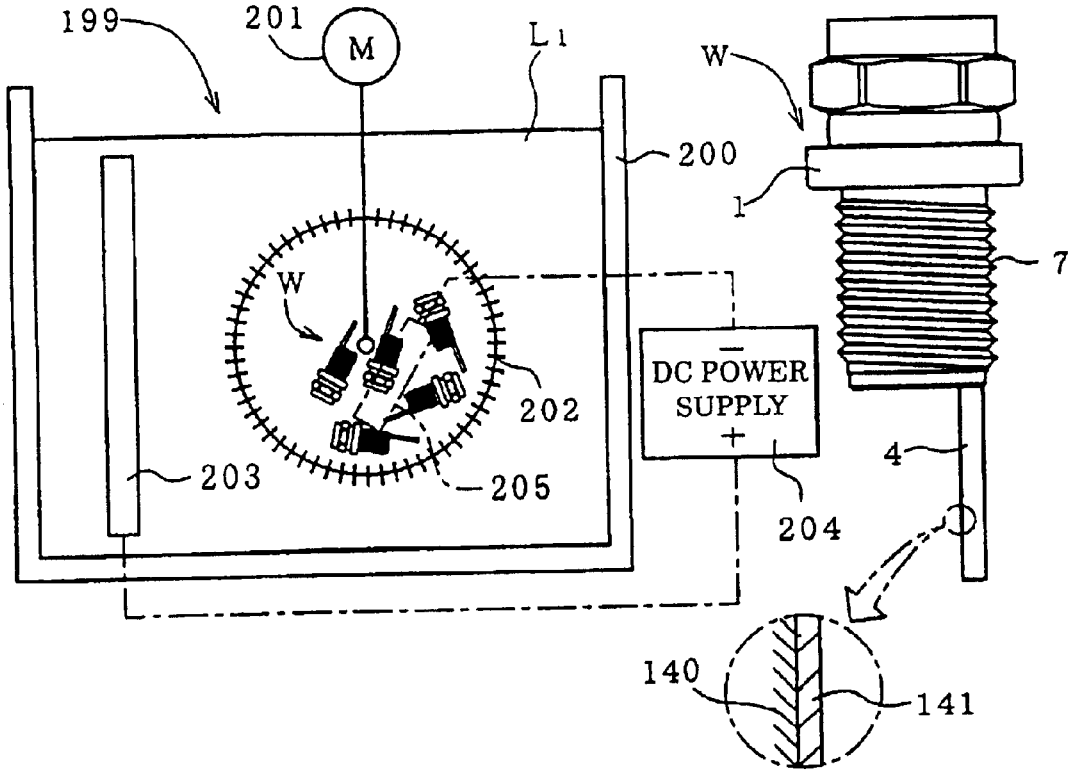
FIG. 3 is a schematic view showing a barrel-type electrolytic galvanization apparatus.

When the process for removing the zinc plating layer 141 is completed, the metallic shell assemblies W are cleaned and dried, followed by chromate treatment. The present embodiment uses a chromate treatment tank 250 (features common to those of FIG. 3 are denoted by common reference numerals) shown in FIG. 4. The chromate treatment tank 250 contains a chromate treatment liquid L2. The present embodiment performs non-electrolytic chromate treatment; thus, the chromate treatment tank 250 is not equipped with electrodes and a power supply for inducing current flow. Notably, electrolytic chromate treatment is possible. In this case, an apparatus similar to that of FIG. 3 may be used.

The chromate treatment liquid L2 contains a trivalent chromium salt and a complexing agent for trivalent chromium, thereby enabling formation of a fine, thick trivalent-chromium-based chromate layer. Specifically, a chromate (Cr(III)) layer having a thickness of 0.2 $\mu$m to 0.5 $\mu$m can be formed easily. Such a chromate treatment liquid is disclosed in German Patent Publication No. DE19638176A1. The contents of the publication will be briefly described below.

As mentioned previously, a chromate layer is known to be formed in the following manner. In a chromate treatment bath, a base metal (for example, zinc) is released into the bath through oxidation. The released base metal component reacts with chromate ions contained in the chromate treatment bath to form a polymeric complex of trivalent chromium bridged by means of hydroxyl groups or oxygen atoms. This polymeric complex deposits on the surface of the base metal in the form of a gel. In order to grow a chromate layer, release of the base metal must progress in parallel with reaction between the released base metal and chromate ions contained in the bath and deposit of the resultant complex. However, when the chromate layer grows to a certain extent, release of the base metal is prevented, since the reaction occurs heterogeneously at the interface between the base metal and the bath. As a result, the growth of the chromate layer stagnates.

According to above-mentioned German Patent Publication No. DE19638176A1, it is important in increasing the thickness of the chromate layer that while the rate of dissolution of the base metal and the rate of deposit of the chromate layer formed through reaction between a dissolved base metal component and trivalent chromium are increased, the rate of redissolution of the deposited chromate layer is decreased as much as possible. According to the above-described method, through addition of an appropriate complexing agent to the bath for forming trivalent chromium complex, deposit of the chromate layer is accelerated, thereby enabling an increase in the thickness of the chromate layer.

Effective complexing agents include chelating agents (dicarboxylic acid, tricarboxylic acid, and oxy acid (hydroxydicarboxylic acid or hydroxytricarboxylic acid; for example, oxalic acid, malonic acid, succinic acid, glutaric acid, adipic acid, pimelic acid, suberic acid, azelaic acid, sebacic acid, maleic acid, phthalic acid, terephthalic acid, tartaric acid, citric acid, malic acid, and ascorbic acid). Other complexing agents may be used. Usable complexing agents are described in the above-mentioned German Patent Publication No. DE19638176A1.

Raising the temperature of the chromate treatment bath to about 20° C. to 80° C. is effective in the increase of the thickness of the chromate layer. A bath temperature lower than 20° C. hardly contributes to an increase in the layer thickness. When the bath temperature is 80° C. or higher, water evaporates greatly from the bath, causing difficulty in control of bath conditions. Preferably, articles which undergo chromate treatment (metallic shells and gaskets) are immersed in the chromate bath for 20 to 80 seconds. When the immersion period of time is less than 20 seconds, the formed chromate layer may fail to become sufficiently thick. When the immersion period of time is longer than 80 seconds, the formed chromate layer becomes too thick, potentially causing cracking in the chromate layer (for example, in the course of assembly) or exfoliation of the chromate layer with a resultant impairment in anticorrosive performance.

Lowering pH of the chromate treatment liquid so long as redissolution of the deposited chromate layer is not intensified is effective in accelerating dissolution of the base metal. Preferred pH ranges, for example, from 1.5 to 3. Incorporation of nickel hydroxide, cobalt hydroxide, or copper hydroxide into the deposited chromate layer is effective in suppression of redissolution of the deposited chromate layer, since these hydroxides are less likely to be redissolved. To this end, a nickel compound, a cobalt compound, or a copper compound may be added to the chromate treatment bath.

The inventor of the present invention studied further and found that through addition of sodium salt (for example, sodium nitrate) to the chromate treatment bath such that the sodium content of the chromate layer becomes 2% by weight to 7% by weight, a fine, thick chromate layer was formed more easily. A detailed mechanism of this is unknown.

Conceivably, sodium ions incorporated into the chromate layer have a function for retarding redissolution of the chromate layer in the chromate treatment bath. When the sodium content of the chromate layer falls outside the range of 2% by weight to 7% by weight, the chromate layer may encounter difficulty in assuming a thickness of not less than 0.2 $\mu$m. More preferably, the sodium content of the chromate layer is 2% by weight to 6% by weight.

The process for forming the zinc-chromate layer on the gasket 30 is similar to the above-described process for forming the zinc-chromate layer on the metallic shell 1 (or the metallic shell assembly W) except that the process for removing the zinc plating layer is not involved.

Figure 4:
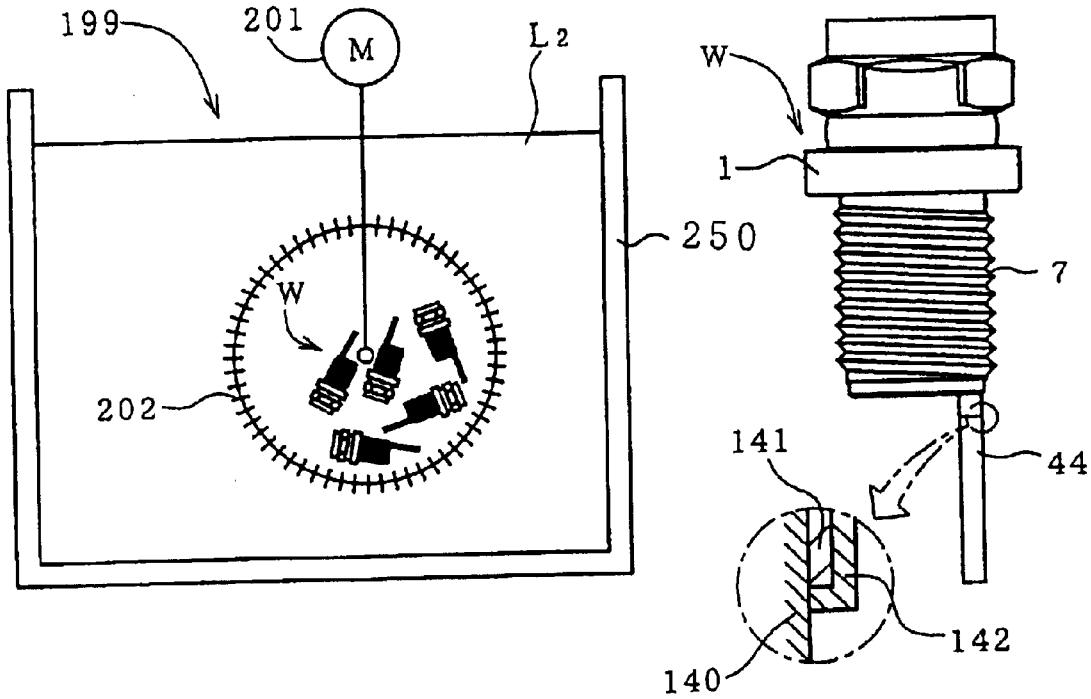
FIG. 4 is a schematic view showing a barrel-type chromate treatment apparatus.
Figure 6C:
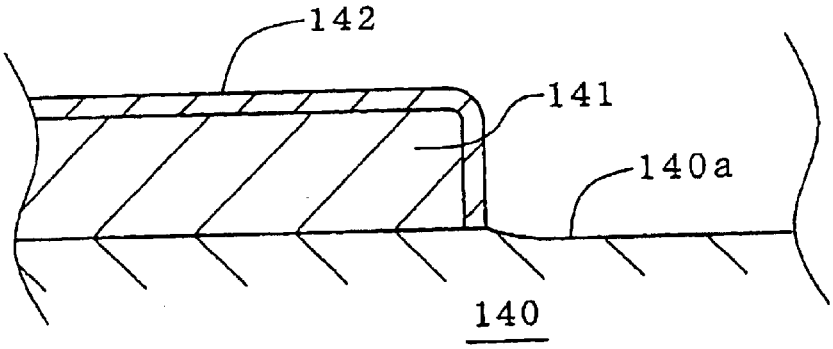
FIG. 6C is a schematic view showing a chromate layer on a zinc layer on the base metal according to the process of the present invention.
Figure 6D:
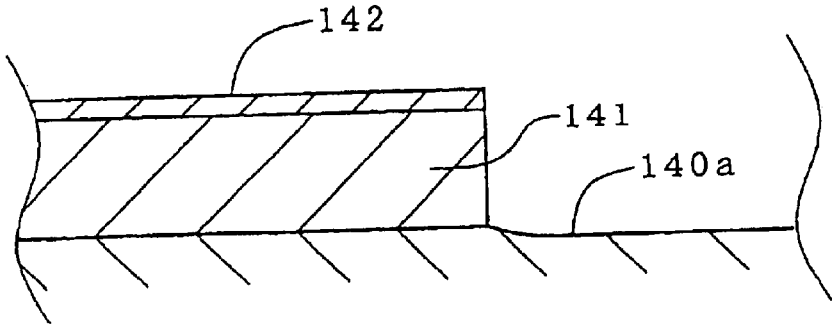
FIG. 6D is a schematic view showing a chromate layer and a zinc layer having an end face without chromate on a base metal prepared by a conventional (prior art) process for forming a zinc-chromate layer.

In the above-described chromate treatment, as shown in FIG. 4, the entire metallic shell assembly W is immersed in the chromate treatment bath; in other words, the free-end portion of the ground electrode 4 from which the zinc plating layer 141 has been removed is also immersed in the bath. However, as shown in FIG. 6C, the chromate layer 142 is formed only on the surface of the zinc plating layer 141, on which substitution for zinc can progress. Formation of a chromate layer on the exposed surface 140*a* of the base metal 140 hardly progresses. By contrast, formation of a chromate layer progresses even on the end face of the zinc plating layer 141. As a result, the zinc plating layer 141 including the end face thereof is covered with the chromate layer 142, so that no portion of the zinc plating layer 141 is exposed. Thus, corrosion of the zinc plating layer 141 is effectively-suppressed in the course of use of the spark plug. This is an improvement over the product of a conventional (prior art) process illustrated in FIG. 6D wherein the chromate layer is not present on an end face of the zinc-based plating layer 141 thereby increasing the likelihood of corrosion.

Referring to FIG. 2, an example method for forming the spark portions 31 and 32 will be described. These spark portions 31 and 32 are formed before the insulator 2 or the center electrode 3 is attached to the metallic shell 1. First, the spark portion 31 of the center electrode 3 is formed in the following manner. Being positioned on the end face of the center electrode 3, a chip (for example, a disk-like chip) of a high melting point metal is welded to the center electrode 3 through formation of an annular bead 10, thereby forming the spark portion 31.

Figure 7B:
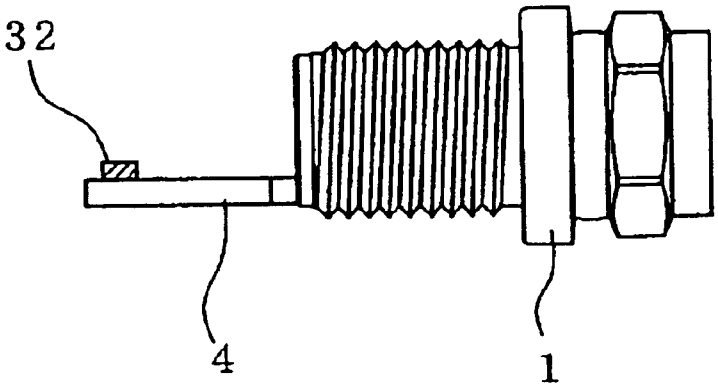
FIG. 7B is a schematic view showing the second step in a process for forming a spark portion on a ground electrode through resistance welding.
Figure 7C:
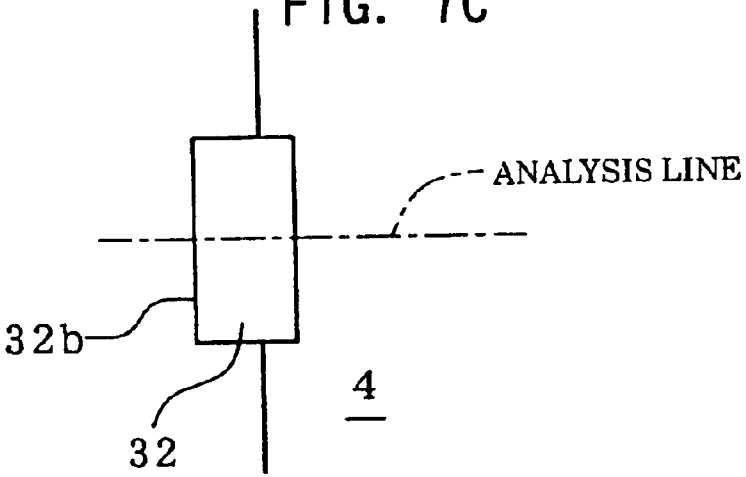
FIG. 7C is a schematic view showing setting of an analysis line.
Figure 7A:
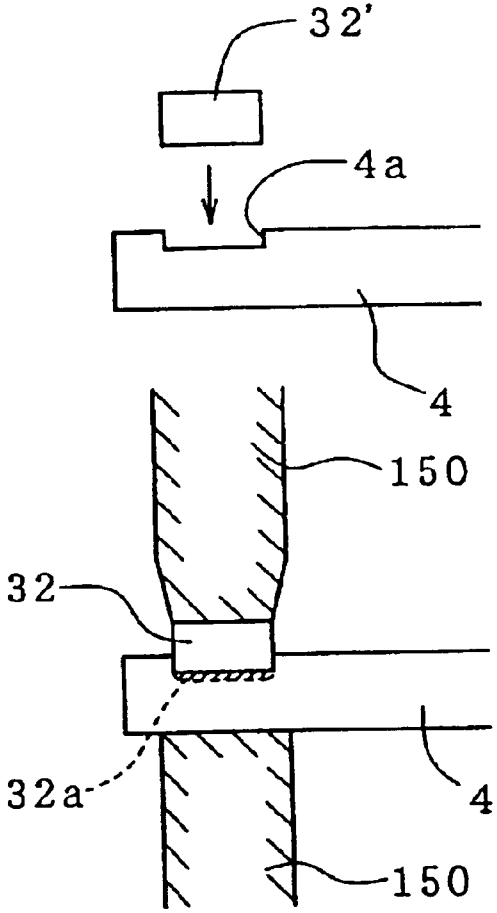
FIG. 7A is a schematic view showing the first step in a process for forming a spark portion on a ground electrode through resistance welding.

The spark portion 32 of a Pt-based metal of the ground electrode 4 is formed in the following manner. As shown in FIG. 7A, a positioning recess 4a is formed on a side surface of the ground electrode 4 at a position corresponding to the spark portion 31 of the center electrode 3. The disk-like chip of a Pt-based metal (hereinafter called merely a chip) 32' is fitted into the recess 4*a*. The chip 32' is obtained by, for example, slicing a rod of a Pt-based metal through discharge machining or blanking a plate of a Pt-based metal. Subsequently, the ground electrode 4 and the chip 32' are held between electrodes 150. Electricity is supplied to the electrodes 150 from a welding power supply (not illustrated), thereby forming a diffusion layer (weld zone) 32*a*.

In formation of the spark portion 32 on the side surface of the ground electrode 4, the chip 32' may be laser-welded to the ground electrode 4. However, while the chip 32' is positioned with respect to the horizontally extending ground electrode 4, a laser beam generator and the ground electrode 4 must be rotated relative to each other such that a laser beam travels along the circumference of the chip 32'. Thus, this laser welding process is somewhat complicated. If a Pt-based metal is employed as material for the spark portion 32, sufficient weld strength can be imparted to the spark portion 32 even when a simple welding process, such as resistance welding, is employed, since a Pt-based metal is lower in melting point than Ir.

In an ordinary spark plug, in which the center electrode 3 is of negative polarity, the temperature of the spark portion 31 formed at the end face of the center electrode 3 tends to increase. Thus, the spark portion 31 is highly subjected to an attack of positive ions derived from spark discharge and is thus susceptible to consumption. By contrast, the spark portion 32 of the ground electrode 4 exhibits a smaller increase in temperature and is less subjected to an attack of positive ions and is thus less susceptible to consumption. Accordingly, even when the spark portion 32 of the ground electrode 4 is made of a Pt-based metal, the spark portion 32 can exhibit sufficient resistance to consumption. Also, even when the spark portion 32 is formed through resistance welding, the spark portion 32 hardly suffers separation from the ground electrode 4. A Pt-based metal exhibits good machinability and thus can be readily machined into a member used for formation of the spark portion 32.

Since acid used for removal of the zinc plating layer 141 activates the exposed surface 140*a* of the base metal, mutual diffusion between the chip 32' and the base metal 140 is likely to progress in the course of resistance welding, thereby increasing the average thickness of the diffusion layer 32*a* formed at the interface where the spark portion 32 and the ground electrode 4 are joined. Specifically, the diffusion layer 32*a* can reliably have an average thickness of not less than 10 $\mu$m, thereby greatly increasing weld strength of the spark portion 32.

The thickness of the diffusion layer 32*a* is defined as follows. As shown in FIG. 7C, on the cross section of the spark portion 32 and the base metal 140 taken perpendicularly to a spark face 32*b*, an analysis line is drawn perpendicularly to the spark face 32*b*. Electron Probe Micro Analysis (EPMA) is performed along the analysis line so as to obtain the distribution of the intensity of characteristic X-ray, or a ray analysis profile, for Pt contained predominantly in the spark portion 32 and a component (Ni in the present embodiment) contained predominantly in the base metal 140. In order to eliminate influence of noise from an obtained ray analysis profile, it is preferable that fine intensity variation components corresponding to a wavelength of less than 1 $\mu$m be filtered out.

Figure 8:
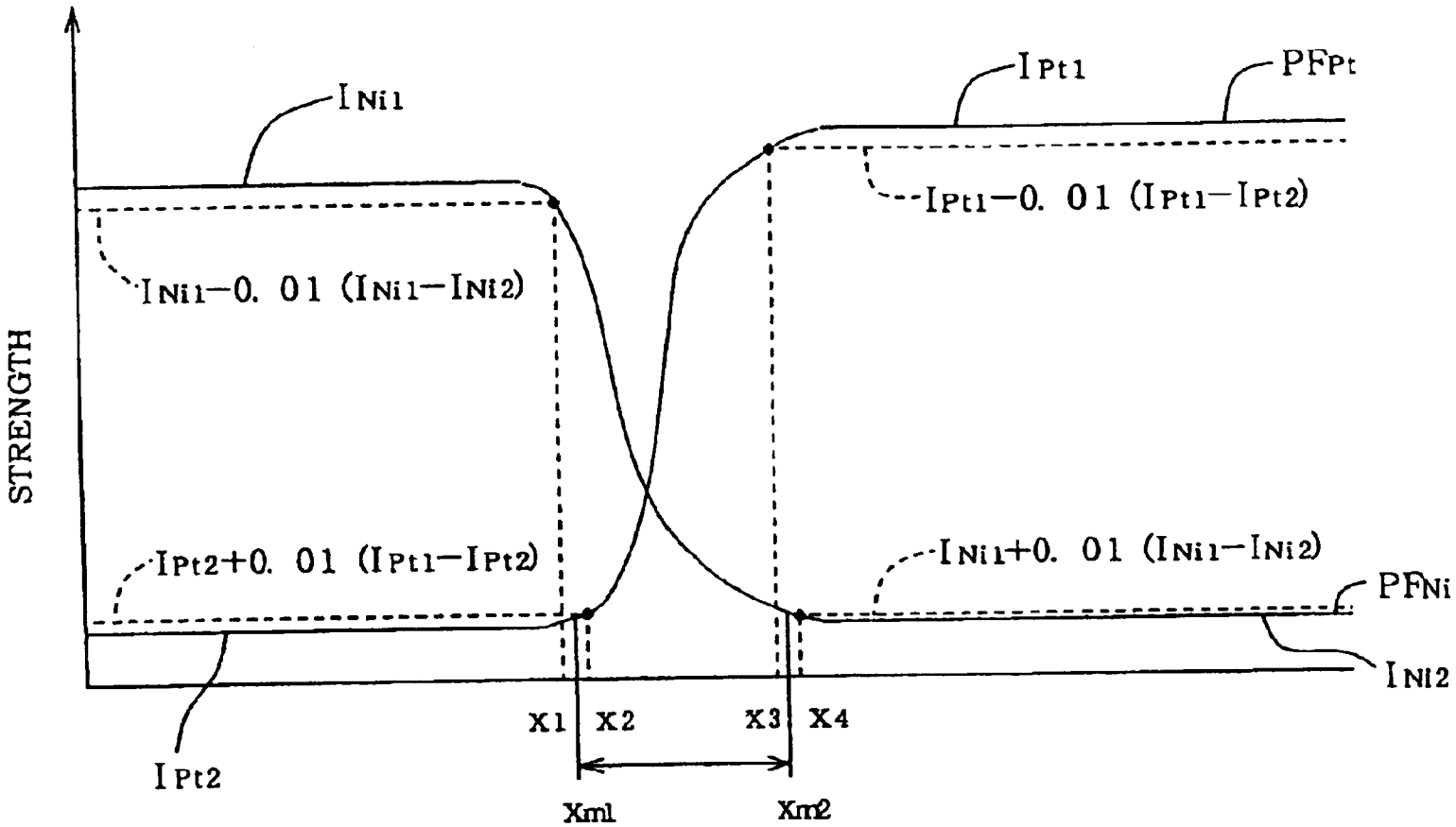
FIG. 8 is a graph showing definition of the thickness of a diffusion layer.

As shown in FIG. 8, IPt1 represents the average intensity of characteristic X-ray for Pt in the spark portion 32, and INi2 represents the average intensity of characteristic X-ray for Ni in the spark portion 32. Similarly, INi1 represents the average intensity of characteristic X-ray for Ni in the base metal 140, and IPt2 represents the average intensity of characteristic X-ray for Pt in the base metal 140. Next, ray analysis profiles obtained for Pt and Ni along the analysis line are represented on a coordinate system in which the y-axis represents intensity I of characteristic X-ray, and the x-axis represents distance x as measured along the analysis line. Thickness t of the diffusion layer is defined as $t=|xm1-xm2|$, where: $(x1+x2)/2=xm1$; $(x3+x3)/2=xm2$; x1 is an x-coordinate of the intersection of a ray analysis profile for Ni, PFNi, and a line representing "I=INi1−0.01(INi1−INi2)"; x2 is an x-coordinate of the intersection of a ray analysis profile for Pt, PFPt, and a line representing "I=IPt2+0.01(IPt−IPt2)"; x3 is an x-coordinate of the intersection of a ray analysis profile for Pt, PFPt, and a line representing "I=IPt1−0.01(IPt−IPt2)"; and x4 is an x-coordinate of the intersection of a ray analysis profile for Ni, PFNi, and a line representing "I=INi2+0.01(INi1−INi2)." When a measured value of t varies depending on the set position of the analysis line, preferably, a plurality of values of t are measured for different positions of the analysis line, and the average of the measured values of t is taken as the value of t.

When formation of the spark portions 31 and 32 is completed, the insulator 2, the center electrode 3, and other components are attached to the metallic shell 1. Then, the ground electrode 4 is bent such that the spark portions 31 and 32 face each other as shown in FIG. 2, thereby completing the spark plug 100 shown in FIG. 1.

EXAMPLES

In order to confirm the effect of the present invention, the following experiment was conducted. First, wire having a rectangular cross section measuring 1.5 mm×2.8 mm of INCONEL 600 was prepared as material for the ground electrode 4 and cut into pieces, each having a length of 14 mm. The metallic shells 1 shown in FIG. 1 were cold-forged from carbon steel wire SWCH8A specified in JIS G 3539 "Carbon Steel Wires for Cold Heading and Cold Forging." The male threaded portion 7 of the metallic shell 1 had a nominal size of 14 mm and an axial length of about 19 mm. The above-mentioned pieces of wire of INCONEL 600 were resistance welded to the corresponding metallic shells 1, thereby yielding the metallic shell assemblies W shown in FIG. 3. The metallic shell assemblies W were electrolytically galvanized in a known alkaline cyanide bath by use of the barrel plating apparatus shown in FIG. 3, thereby forming a zinc plating layer of an about 6 $\mu$m thickness thereon.

Next were prepared aqueous solutions which contained nitric acid and/or hydrochloric acid according to compositions shown in Table 1. These aqueous solutions served as removers. The zinc plating layer was removed from the ground electrode 4 by use of these removers and according to the method shown in FIG. 5. The height of the opening end face of the male threaded portion 7 of the metallic shell 1 above the surface SH of the remover was 1 mm and the immersion period of time was 120 seconds.

The metallic shell assemblies W which had undergone removal of the zinc plating layer were cleaned and then subjected to chromate treatment by use of the apparatus shown in FIG. 4. A chromate treatment bath was prepared by dissolving in deionized water 50 g of chromic chloride (III) ($CrCl_3.6H_2O$), 3 g of cobalt nitrate (II) ($Co(NO_3)_2$), 100 g of sodium nitrate ($NaNO_3$), and 31.2 g of malonic acid per one liter of deionized water. The chromate treatment bath was maintained at a temperature of 60° C. by use of a heater and adjusted to a pH of 2.0 through addition of an aqueous solution of sodium hydroxide. The metallic shell assemblies were immersed in the chromate treatment bath for 60 seconds, followed by cleaning in water and drying. The metallic shell assemblies W were dried further by means of warm air having a temperature of 80° C. The thickness of the formed chromate layer was measured by means of SEM and found to be about 0.30 $\mu$m. It was also confirmed that the end face of the zinc plating layer 141 was covered with the chromate layer 142 as shown in FIG. 6C. A metallic shell assembly W which had not undergone the process for removing the zinc plating layer was prepared for a comparison purpose (test sample 2 in Table 1).

Next, a Pt chip (1.5 mm (diameter)×0.2 mm (thickness)) was resistance welded to the free-end portion (exposed surface of base metal) of the ground electrode 4 according to the method shown in FIG. 7A to thereby form the spark portion 32. Welding conditions were as follows: load applied between electrodes 150: 40 kgf; secondary current: 1 kA. Notably, for comparison, there was prepared a sample in which a Pt chip was welded to a metallic shell assembly W which had not undergone zinc-chromate treatment (test sample 1 in Table 1).

The metallic shell assemblies W which had undergone formation of the spark portion 32 were evaluated for the appearance of the ground electrode 4, corrosion resistance, and weldability in the following manner. First, in order to evaluate the appearance of the ground electrode 4, the surface of the base metal which had been exposed as a result of removal of the zinc plating layer was visually observed. The appearance of the ground electrode 4 was evaluated as follows: C: significant discoloration was observed; B: almost no discoloration was observed; and A: discoloration was not observed.

Corrosion resistance was tested according to "5. Method of Neutral Salt Spray Test" of JIS H 8502 "Methods of Corrosion Resistance Test for Metallic Coatings." The test period of time was 48 hours. Corrosion resistance was evaluated as follows: X: white rust derived from corrosion of the zinc plating layer accounted for not less than 10% of the total area of the zinc plating layer; B: white rust accounted for less than 10% of the total area; and A: white rust was not observed.

Weldability was tested through subjection to 1000 test cycles. In a single test cycle, the ground electrode 4 was heated by a burner for 2 minutes such that the maximum temperature reached 900° C., and then the ground electrode 4 was allowed to cool at room temperature for 1 minute. The microstructure of a cross section of the spark portion 32 was observed through an optical microscope. Weldability was evaluated as follows: X: separation of the chip was observed; and A: separation of the chip was not observed.

TABLE 1

| | Composition of remover (% by weight) | | | | |
|---|---|---|---|---|---|
| | $HNO_3$ | HCL | Appearance | Salt spray | Weldability |
| 1* | Not plated | | — | — | — |
| 2* | Removal not performed | | A | A | X |
| 3 | 30 | 0 | C | A | A |
| 4 | 0 | 30 | C | A | A |
| 5 | 25 | 25 | B | A | A |
| 6 | 15 | 30 | A | A | A |

*: Outside the scope of the Invention
#: The zinc plating layer was removed after chromate treatment.

As seen from the test results shown in Table 1, the metallic shell assemblies W which underwent chromate treatment after removal of the zinc plating layer exhibit excellent corrosion resistance and weldability. Particularly, the metallic shell assemblies W which underwent removal of the zinc plating layer by use of an aqueous solution of nitric acid and hydrochloric acid serving as remover additionally exhibit good appearance. By contrast, the metallic shell assembly W which underwent welding of the chip to the bare ground electrode 4 or the galvanized ground electrode 4 (test sample 1 or 2) exhibits poor weldability.

Figure 9A:
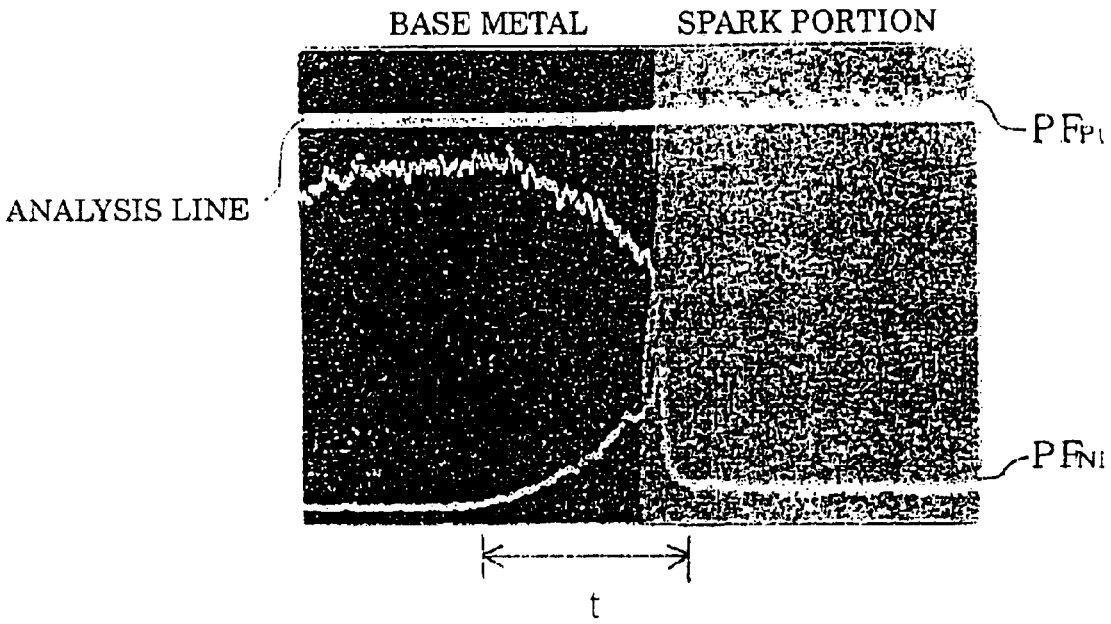
FIG. 9A is a diagram showing ray analysis profiles obtained through EPMA to test sample 6 in order to measure the thickness of a diffusion layer.
Figure 9B:
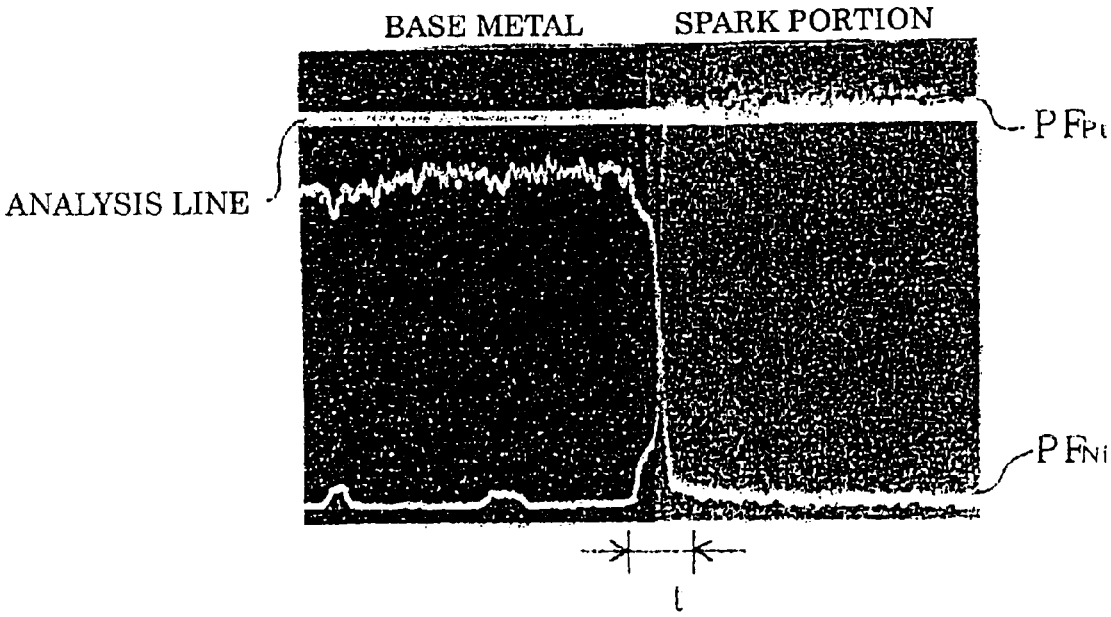
FIG. 9B is a diagram showing ray analysis profiles obtained through EPMA to test sample 1 in order to measure the thickness of a diffusion layer.

The thickness of the diffusion layer 32*a* was measured with respect to test samples 1 and 6 according to the method which has been described above with reference to FIG. 8 (the spot diameter of an electronic probe was 1 μm). FIGS. 9A and 9B show ray analysis profiles obtained by EPMA. FIG. 9A shows a profile for test sample 6 serving as an example of the present invention. The thickness t of the diffusion layer 32*a* was about 22 μm. FIG. 9B shows a profile for test sample 1 serving as a comparative example. The thickness t of the diffusion layer 32*a* was as small as about 10 μm. Before the chip was welded, the amount of residual carbon on the surface of the ground electrode to which the chip was to be welded was measured by X-ray photoelectron spectroscopy with respect to test samples 1 and 6. As a result, the amount of residual carbon of test sample 6 was not greater than ¼ that of test sample 1. Conceivably, removal of the zinc plating layer caused a reduction in the amount of residual carbon on the surface of the base metal 140 of the ground electrode 4, thereby activating the surface of the base metal 140. As a result, mutual diffusion between the base metal 140 and the chip 32' of a Pt-based metal was accelerated in the course of resistance welding.

What is claimed is:

1. A method for manufacturing a spark plug comprising a center electrode, an insulator disposed around the center electrode, a cylindrical metallic shell disposed around the insulator, a ground electrode disposed in opposition to the center electrode so as to form a spark discharge gap therebetween, and a chip of a high melting point metal welded to at least the ground electrode at a position corresponding to the spark discharge gap so as to form a noble-metal spark portion having a discharge face, said method comprising the steps of:

preparing a metallic shell assembly through joining of a root-end portion of the ground electrode to an open end portion of the metallic shell;

forming a zinc-based plating layer containing a predominant amount of zinc on the entire surface of the metallic shell assembly;

removing the zinc-based plating layer from a free-end of the ground electrode of the metallic shell assembly covered with the zinc-based plating layer; and welding the chip of a high melting point metal to the free-end portion of the ground electrode from which the zinc-based plating layer has been removed.

2. A method for manufacturing a spark plug according to claim 1, wherein in said step of removing the zinc-based plating layer, the ground electrode covered with the zinc-based plating layer is immersed in a remover so as to chemically remove the zinc-based plating layer therefrom.

3. A method for manufacturing a spark plug according to claim 2, wherein the ground electrode covered with the zinc-based plating layer is immersed in an acid remover so as to electrolessly remove the zinc-based plating layer therefrom.

4. A method for manufacturing a spark plug according to claim 3, wherein the acid remover contains at least any one of nitric acid, hydrochloric acid, sulfuric acid, and an organic acid.

5. A method for manufacturing a spark plug according to claim 4, wherein a mixture of nitric acid and hydrochloric acid is used as the acid remover.

6. A method for manufacturing a spark plug according to claim 2, wherein the ground electrode is immersed in the remover such that a predetermined length of the root-end portion is exposed above a surface of the remover while the remaining free-end portion is submerged in the remover, thereby removing the zinc-based plating layer from the submerged free-end portion.

7. A method for manufacturing a spark plug according to claim 6, wherein the spark plug to be manufactured has a structure such that the free-end portion of the ground electrode is bent so as to form the spark discharge gap in cooperation with an end portion of the center electrode;

the metallic shell assembly is configured such that the ground electrode before being bent is joined to the metallic shell in such a manner as to extend linearly in an axial direction of the metallic shell assembly; and the metallic shell assembly is held such that the ground electrode extends downward so as to immerse the free-end portion of the ground electrode in the remover.

8. A method for manufacturing a spark plug according to claim 7, wherein the chip of a high melting point metal contains a predominant amount of Pt and is welded through resistance welding.

9. A method for manufacturing a spark plug according to claim 1, further comprising a step of forming a chromate layer on the zinc-based plating layer through chromate treatment, wherein the chromate treatment is performed after completion of said step of removing the zinc-based plating layer from the free-end portion of the ground electrode.

10. A method for manufacturing a spark plug according to claim 1, wherein the ground electrode is formed of an Ni-based heat-resistant alloy or an Fe-based heat-resistant alloy.

11. A method for manufacturing a spark plug comprising a center electrode, an insulator disposed around the center electrode, a cylindrical metallic shell disposed around the insulator, and a ground electrode disposed in opposition to the center electrode so as to form a spark discharge gap therebetween, said method comprising the steps of:

preparing a metallic shell assembly through joining of a root-end portion of the ground electrode to an open end portion of the metallic shell so that the ground electrode extends from said metallic shell in an axial direction;

forming a zinc-based plating layer containing a predominant amount of zinc on the entire surface of the metallic shell assembly excluding a free-end portion of the ground electrode, said zinc-based plating layer comprising an axial end face adjacent said free-end portion; and immersing in a chromate treatment liquid the entire metallic shell assembly which has undergone said step of forming the zinc-based plating layer, thereby subjecting the zinc-based plating layer including said axial end face to chromate treatment.

12. A method for manufacturing a spark plug according to claim 11, wherein the ground electrode is formed of an Ni-based heat-resistant alloy or an Fe-based heat-resistant alloy.

13. A spark plug comprising:

a center electrode;

an insulator disposed around the center electrode;

a metallic shell disposed around the insulator;

a ground electrode disposed in opposition to the center electrode so as to form a spark discharge gap therebetween, the ground electrode being formed of an Ni-based metal containing a predominant amount of Ni or an Fe-based metal containing a predominant amount of Fe; and a Pt-based metal chip containing a predominant amount of Pt and welded to the ground electrode, wherein a surface of said metallic shell and a surface of a root-end portion of said ground electrode are covered with a zinc-chromate layer including a zinc-based plating layer containing a predominant amount of zinc and a chromate layer covering the zinc-based plating layer, such that a free-end portion of the ground electrode is exposed and further such that said zinc-based plating layer includes an end face intersecting the free-end portion and said chromate layer covers said end face;

the Pt-based metal chip is welded to the exposed free-end portion of the ground electrode at a position corresponding to the spark discharge gap so as to form a noble-metal spark portion; and a diffusion layer, formed at an interface where the noble-metal spark portion and the ground electrode are joined, has a thickness of not less than 10 $\mu$m.

14. A spark plug comprising:

a center electrode;

an insulator disposed around the center electrode; a metallic shell disposed around the insulator; and a ground electrode disposed in opposition to the center electrode so as to form a spark discharge gap therebetween, wherein a surface of said metallic shell and a surface of a root-end portion of said ground electrode are covered with a zinc-chromate layer including a zinc-based plating layer containing a predominant amount of zinc and a chromate layer covering the zinc-based plating layer, such that a free-end portion of said ground electrode is exposed without being covered with the zinc-based plating layer; and the chromate layer is formed in such a manner as to cover an axial end face of the zinc-based plating layer with respect to an axial direction of said ground electrode.

15. A spark plug as described in claim 14, wherein a noble metal spark portion is formed by a Pt-based metal chip containing a predominant amount of Pt and provided on at least said ground electrode at a position corresponding to the spark discharge gap whereby; and a diffusion layer, formed at an interface where the noble-metal spark portion and the ground electrode are joined, has a thickness of not less than 10 $\mu$m.

* * * * *

UNITED STATES PATENT AND TRADEMARK OFFICE

CERTIFICATE OF CORRECTION

PATENT NO. : 6,750,597 B1
DATED : June 15, 2004
INVENTOR(S) : Akio Sakura

It is certified that error appears in the above-identified patent and that said Letters Patent is hereby corrected as shown below:

Title page,
Item [30], Foreign Application Priority Data, delete "11-240206" and substitute -- HEI-11-240206 -- in its place.

Column 16,
Line 17, after "from a free-end" insert -- portion --.

Signed and Sealed this

Fourteenth Day of December, 2004

JON W. DUDAS
*Director of the United States Patent and Trademark Office*